US008899699B2

(12) United States Patent
Fulterer

(10) Patent No.: US 8,899,699 B2
(45) Date of Patent: Dec. 2, 2014

(54) PULL-OUT BLOCKING DEVICE

(75) Inventor: Axel Fulterer, St. Margrethen (CH)

(73) Assignee: FULTERER Gesellschaft mbH, Lustenau (AT)

( * ) Notice: Subject to any disclaimer, the term of this patent is extended or adjusted under 35 U.S.C. 154(b) by 111 days.

(21) Appl. No.: 13/417,596

(22) Filed: Mar. 12, 2012

(65) Prior Publication Data

US 2012/0242201 A1 Sep. 27, 2012

(30) Foreign Application Priority Data

Mar. 10, 2011 (AT) ..... A324/2011

(51) Int. Cl.
*E05B 65/46* (2006.01)

(52) U.S. Cl.
CPC ..... *E05B 65/464* (2013.01)
USPC ..... 312/221; 312/217

(58) Field of Classification Search
USPC ..... 312/294, 330.1, 216, 217, 218, 219, 312/220, 221, 107.5
See application file for complete search history.

(56) References Cited

U.S. PATENT DOCUMENTS

| | | | | |
|---|---|---|---|---|
| 4,298,236 | A | 11/1981 | Laroche | |
| 4,711,505 | A * | 12/1987 | Lakso | 312/220 |
| 5,427,445 | A * | 6/1995 | Mitchell | 312/221 |
| 5,599,078 | A | 2/1997 | Dechene et al. | |
| 5,988,778 | A | 11/1999 | Lammens | |
| 6,254,205 | B1 | 7/2001 | Wright et al. | |
| 6,450,596 | B1 * | 9/2002 | Lee | 312/217 |
| 8,287,057 | B2 | 10/2012 | Gil | |
| 2005/0040659 | A1 | 2/2005 | Baker et al. | |
| 2007/0182292 | A1 | 8/2007 | Huang | |
| 2011/0005283 | A1 | 1/2011 | Sevillano Gil | |

FOREIGN PATENT DOCUMENTS

| | | |
|---|---|---|
| AT | 007040 | 9/2004 |
| AT | 508905 | 5/2011 |
| AT | 509331 | 8/2011 |
| DE | 3431386 | 3/1986 |
| DE | 3822678 | 1/1990 |
| DE | 4342101 | 6/1994 |
| DE | 19547049 | 6/1996 |
| DE | 19527898 | 8/1996 |
| DE | 19527848 | 2/1997 |

(Continued)

OTHER PUBLICATIONS

Ojmar S.A. Drawing dated Mar. 7, 2007.

(Continued)

*Primary Examiner* — James O Hansen
(74) *Attorney, Agent, or Firm* — Volpe and Koenig, P.C.

(57) ABSTRACT

A pull-out blocking device for furniture parts that can be pushed into or pulled out of a basic furniture structure, the pull-out blocking device having at least one guide rail and a sequence of support elements mounted on the guide rail displaceable in the longitudinal direction thereof, each support element having an upper supporting surface for abutment against a support element arranged adjacently above, a lower supporting surface for abutment against a support element arranged adjacently below and at least one further supporting surface for abutment against the support element arranged adjacently above or below. Each support element is formed as a body that connects the upper, lower, and further supporting surfaces together in an inherently rigid manner, and each support element is pivotably arranged on the guide element for movement between the blocking and releasing positions, and all the supporting surfaces are arranged outside the guide element.

15 Claims, 8 Drawing Sheets

(56) References Cited

FOREIGN PATENT DOCUMENTS

| | | |
|---|---|---|
| DE | 29620152 | 5/1997 |
| EP | 0738813 | 10/1996 |
| EP | 1059408 | 12/2000 |
| EP | 1148194 | 10/2001 |
| EP | 1154107 | 11/2001 |
| EP | 1336709 | 8/2003 |
| EP | 1500763 | 1/2005 |
| EP | 1637677 | 3/2006 |
| EP | 2053187 | 4/2009 |
| EP | 2128364 | 12/2009 |
| GB | 2318042 | 4/1998 |
| GB | 2376043 | 12/2002 |
| WO | 02099234 | 12/2002 |
| WO | 03016661 | 2/2003 |
| WO | 2008102024 | 8/2008 |
| WO | 2008107499 | 9/2008 |
| WO | 2011069175 | 6/2011 |
| WO | 2011146952 | 12/2011 |

OTHER PUBLICATIONS

WIP Kunststoffverarbeitung Werkzeugbau—Drawing dated Aug. 7, 2008.

HETTICH—System Top 2000 (admitted prior art).

* cited by examiner

PULL-OUT BLOCKING DEVICE

BACKGROUND

The present invention relates to a pull-out blocking device for at least two furniture parts that can be pushed into a basic furniture structure and can be pulled out of the basic furniture structure, in particular drawers, the pull-out blocking device having at least one guide rail and a sequence of support elements mounted on an elongate guide element of the guide rail such as to be displaceable in the longitudinal direction thereof, each support element having, as seen in an operating position of the pull-out blocking device, an upper supporting surface for abutment against a support element arranged adjacently above and a lower supporting surface for abutment against a support element arranged adjacently below and at least one further supporting surface for abutment against the support element arranged adjacently above or below, each support element having a releasing position for abutment by way of its upper supporting surface against the support element arranged adjacently above and for abutment by way of its lower supporting surface against the support element arranged adjacently below, and each support element having a blocking position for abutment by way of its further supporting surface against the support element arranged adjacently above or below.

A large number of embodiments of pull-out blocking devices are known in the prior art. They serve to prevent additional pull-out furniture parts, such as drawers, for example, from being pulled out of a basic furniture structure when other correspondingly pull-out furniture parts, or drawers, have already been pulled out of this basic furniture structure. The intention is to prevent the basic furniture structure from accidentally unbalancing or falling over if too many furniture parts or drawers have been pulled out of it. Usually, such pull-out blocking devices already block the pulling-out of further pull-out furniture parts when just a single pull-out furniture part has been pulled out of the basic furniture structure. Such pull-out blocking devices are known, for example, from DE 195 47 049 A1. In that document, the support elements are constructed in multiple parts. Firstly, the support elements have rods which are mounted in a displaceable manner in the guide element of the guide rail. Secondly, tiltable levers are arranged on the rod-like parts, shown there, of the support elements. These, too, are intended to be assigned in each case to the support element. In this multipart construction of the support elements, the lower supporting surface is located on an additional roller, which is arranged on the rod-like part of the support element and thus is also intended to be assigned to the respective support element. The upper supporting surface and the further supporting surface are located on the pivotable lever.

In DE 195 47 049 A1, the extent of one support element in the direction parallel to the longitudinal direction of the guide element corresponds to the extent of a drawer in the same direction.

In EP 2 128 364 A1, too, the respective support elements of the pull-out blocking device are constructed in multiple parts. Each support element has what is known as a one-piece element which has the upper and the lower support surface. Furthermore, each support element additionally also has a hook which is pivotable with respect to the one-piece element and on which the further supporting surface for the blocking position is located.

SUMMARY

It is the object of the invention to improve pull-out blocking devices of the generic type with regard to a structure which is as simple as possible.

This is achieved in that each support element is formed as a body that connects the upper supporting surface and the lower supporting surface and the further supporting surface together in an inherently rigid manner, and each support element is arranged on the guide element such as to be pivotable about a pivot axis between the blocking position and the releasing position, and all the supporting surfaces are arranged outside the guide element.

It is thus a basic concept of the invention to use, instead of the previous multipart construction, support elements which have, as an inherently rigid body, at least both the upper supporting surface and the lower supporting surface and also the further supporting surface. These three supporting surfaces are thus formed in an inherently rigid manner in the form of a body, this body, that is to say the respective support element, being mounted on the guide element such as to be pivotable about a pivot axis between the blocking position and the releasing position. With regard to the design of the support elements as a single, inherently rigid body, the support elements can also be known in a corresponding manner as blocking hooks or blocking bodies. These inherently rigid bodies according to the invention which form the support elements can of course also have more than just supporting surfaces. The fact that all of the supporting surfaces are arranged outside the guide element makes it possible, by way of a correspondingly large design of the supporting surfaces and correspondingly large distances between the supporting surfaces, to make available a relatively large travel between the blocking position and the releasing position.

For clarification, it should be mentioned that the guide rail is that component which is fastened as such as a rule directly in the basic furniture structure and in this respect carries the remaining parts of the pull-out blocking device. In addition to the guide element, it comprises or carries, for example, also upper and lower stops, as are mentioned further below. Furthermore, in addition to the guide element, the guide rail as a rule also has fastening tabs, by way of which the guide rail can be fitted to the basic furniture structure. Furthermore, a lock for blocking the entire pull-out blocking device can also be provided on the guide rail, as shown in the exemplary embodiments. By contrast, the guide element is only that part of the guide rail on or in which the support elements are actually mounted in a displaceable manner. The guide element can be formed, for example, as a corresponding undercut groove, that is to say, for example, in a channel-like manner. In these embodiments, it is particularly favorable for each support element to have a preferably T-head-shaped guide peg for displaceable mounting on the guide element of the guide rail, preferably by means of engagement therein. It is favorable for the guide peg likewise to form a part of the inherently rigid body which forms the respective support element. If the guide element is in the form of a rod, the support elements according to the invention can have, for example, corresponding guide rings or the like, which engage in an annular manner around the guide element.

It is favorable for the guide element to extend longitudinally in the vertical direction in the operating position of the pull-out blocking device. Its longitudinal direction thus favorably extends parallel to the vertical. The pivot axes, about which the respective support elements are pivotable, extend preferably orthogonally to the longitudinal direction of the guide element. However, it is also possible for the guide element to extend longitudinally in the horizontal direction in the operating position of the pull-out blocking device or for its longitudinal extent to extend at an angle between the vertical and the horizontal in said operating position.

Particularly preferred forms of the design of the support element as an inherently rigid body provide that each support element is formed as a body that connects the lower supporting surface and the upper supporting surface and the further supporting surface, and preferably also the guide peg, together in an inherently integral manner. Here, too, more than the three mentioned supporting surfaces can also be integrated in an integral manner in the support element. In this context, integral means in particular that all the parts of the support element consist of one and the same material and are connected fixedly together as one piece. For the sake of completeness, however, reference is made to the fact that the support elements can also be in the form of inherently rigid bodies when individual parts of the support element consist of different materials or parts, but these parts are connected together in a fixed and inherently rigid manner.

Particularly preferred variants provide that each support element is formed as an integral, preferably injection molded, plastics body or as an integral metal or ceramic body.

In order to move each support element from its releasing position into its blocking position, or vice versa, preferred embodiments of the invention provide that the pull-out blocking device has trigger elements, by way of which the support elements can be actuated or pivoted. It is favorable for at least one such trigger element to be provided per pull-out furniture part. Preferred embodiments of the interaction between the support element and the trigger element provide that each support element has a pivot arm, which is arranged eccentrically with regard to its pivot axis, in order to pivot the support element about its pivot axis by means of a preferably peg-shaped trigger element arranged on the pull-out furniture part. In this case, it should be noted that trigger elements do not have to be formed in a peg-shaped manner, but can also have other shapes. It is favorable for these trigger elements in any case to interact with the eccentrically arranged pivot arms in order to pivot the respective support element back and/or forth between the releasing position and the blocking position. To this end, the pivot arms can have cutouts for receiving an in particular peg-shaped trigger element. However, it is just as possible, to mention only one further example, for a peg-shaped protrusion to be arranged on the pivot arm, said protrusion interacting with a corresponding cutout in the trigger element.

Preferred embodiments of a pull-out blocking device according to the invention provide that preferably precisely one preferably peg-shaped trigger element, which can be arranged on the pull-out furniture part, is able to pass through between two support elements arranged adjacent to one another, the trigger element forcibly pivoting one of the support elements from its releasing position into its blocking position or vice versa as said trigger element passes through. It is favorable, in particular in this context, for the upper supporting surface and the lower supporting surface each to have a run-on slope for a preferably peg-shaped trigger element arranged on the pull-out furniture part.

It is also favorable for the displaceability of the support elements along the guide element to be confined between two stops, all the remaining or other support elements being fixed in position in relation to the stops when or after at least one of the support elements has been arranged in its blocking position. This is applicable in particular when all the other pull-out furniture parts, or drawers, are already intended to be blocked when a single pull-out furniture part, or a single drawer, is extracted from the basic furniture structure. If the intention is to allow more than one pull-out furniture part to be pulled out of the basic furniture structure, then the remaining support elements are fixed between the stops only when a corresponding number of support elements are arranged in their blocking position. This can be set up easily by corresponding arrangements of the stops in coordination with the dimensioning of the support elements.

With regard to a structure which is as simple as possible, it is favorable for all the support elements of the pull-out blocking device to have an identical shape to one another. The support elements should define a certain spacing. In particular, in preferred embodiments, all the support elements have, in their releasing position, as seen in the longitudinal direction of the guide element, the same distance between their respective upper and lower supporting surfaces. The corresponding extent, in the longitudinal direction of the guide element, of the assigned drawers or pull-out furniture parts should then be an integer multiple of said longitudinal extent of a support element arranged in its releasing position. Preferred embodiments provide in this case real integer multiples, that is to say integer multiples greater than or equal to 2. However, said integer multiple can also be 1.

A first group of pull-out blocking devices provides that exclusively support elements according to the invention, preferably having an identical shape to one another, are arranged on the guide element. However, other embodiments of the invention provide that intermediate elements are arranged between support elements according to the invention, said intermediate elements being likewise displaceable along the guide element. This is particularly practical when a relatively fine spacing is defined by the dimensioning of the support elements, but relatively large drawers are present in regions. In order to reduce the number of necessary support elements in such pull-out blocking devices, some support elements can then be replaced by corresponding intermediate elements. These intermediate elements can have a simpler structure. Thus, for example, unlike the support elements, they do not have to be mounted on the guide element such as to be pivotable about a pivot axis. The intermediate elements may be simple rod-like entities or the like. However, the intermediate element should fit into the spacing defined by the dimensioning of the support elements. In this regard, preferred embodiments provide that at least one intermediate element that is mounted on the guide element so as to be displaceable in the longitudinal direction thereof is arranged between at least two support elements, the longitudinal extent of the intermediate element, as seen in the longitudinal direction of the guide element, being a preferably real integer multiple of the longitudinal extent of a support element arranged in its releasing position.

BRIEF DESCRIPTION OF THE DRAWINGS

Further features and details of preferred embodiments of the invention are explained by way of the description of the figures, in which.

DETAILED DESCRIPTION OF THE PREFERRED EMBODIMENTS

Figure 3:
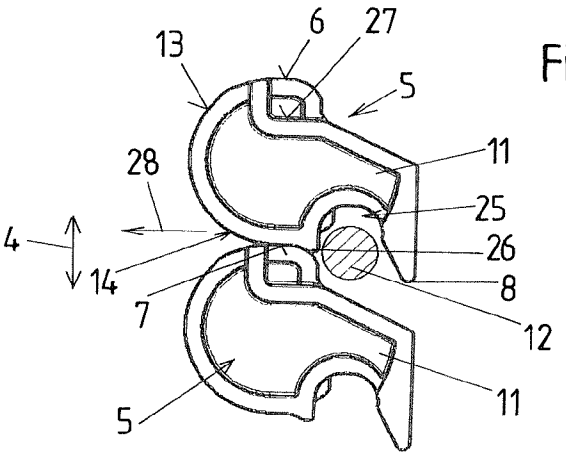
FIGS. 1 to 16 show a first exemplary embodiment of a pull-out blocking device according to the invention, in which exclusively support elements according to the invention are arranged in a displaceable manner on the guide element.

Four different operating states are shown for the first exemplary embodiment in FIGS. 1 to 16. In each case four figures are present for each operating state. FIGS. 1 to 4 show an operating state in which the pull-out furniture parts, or drawers, which are not shown here, have been pushed completely into the basic furniture structure, which is likewise not shown. Thus, all the support elements 5 are still in their releasing position, in which one of the furniture parts which are not illustrated here can be pulled out of the basic furniture structure. FIGS. 5 to 8 and FIGS. 9 to 12 show two operating states that occur directly after one another, when, while one of the movable furniture parts, in this case the upper one, is being pulled out of the basic furniture structure, one of the support elements 5 has already been pivoted into its blocking position. FIGS. 13 to 16 then show the situation in which the trigger element 12 has been pulled completely out of the arrangement of support elements 5 and the support element 5 located in the blocking position is preventing the second furniture part from being pulled out. In each case at least one trigger element carrier 21 is fastened to the pull-out furniture parts, or drawers, which are not illustrated here. The direction in which the furniture parts (not illustrated) are pulled out of the basic furniture structure is indicated by the arrow 28. The furniture parts or drawers are pushed back into the basic furniture structure in the opposite direction. The illustrated exemplary embodiment of a pull-out blocking device 1, in the variant shown, is equipped with two trigger element carriers 21 and corresponding trigger elements 12. In the variant illustrated, the pull-out blocking device thus serves for two pull-out furniture parts, or drawers. In the case of correspondingly shallower drawers, but also in the case of more than, for example, three drawers, the same pull-out blocking device 1 can then be used with a corresponding number of trigger elements 12. The drawer heights ultimately only have to match the unit spacing of the support elements 5. The unit spacing is defined by the longitudinal extent 19 of the support elements 5 in their releasing position, in which in the example shown the lower supporting surface 7 of the respectively upper support element 5 is arranged on the upper supporting surface 6 of the respectively lower adjacent support element 5.

FIGS. 1, 5, 9 and 13 each show a perspective illustration of the pull-out blocking device 1 formed according to the invention. FIGS. 2, 6, 10 and 14 each show a side view. FIGS. 3, 7, 11 and 15 separately illustrate in each case the two support elements 5 interacting with the upper trigger element 12. With reference to FIGS. 3, 7, 11 and 15, FIGS. 4, 8, 12 and 16 each show the views from the opposite side, that is to say from the direction of the guide element 3.

Figure 33:
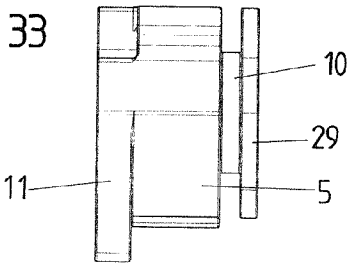
FIG. 33 shows a side view of a single support element of the two preferred exemplary embodiments.

The pull-out blocking device 1 illustrated has a guide rail 2. This has in turn a mounting plate 24, by way of which the pull-out blocking device 1 is fastened to the basic furniture body (not illustrated here). Furthermore, the guide rail 2 has the guide element 3, on which the support elements 5 are mounted such as to be displaceable in the longitudinal direction 4 of the guide element 3. In the exemplary embodiment shown, the longitudinal direction 4 of the guide element 3 extends parallel to the vertical. In the exemplary embodiment shown, the guide element 3 is configured as a groove-like channel having peripheral undercuts. Each support element has a guide peg 10, by way of which the respective support element 5 is mounted in a displaceable manner in the guide element 3 or engages in the guide element 3. FIG. 33 shows a side view of the support element 5, in which it can clearly be seen that the guide peg 10 of this exemplary embodiment is formed in each case in a T-head-shaped manner. The head plate 29, which is guided directly in the guide element 3, of the guide peg 10 is formed in the exemplary embodiment shown such that, by corresponding abutment in the groove-like guide element 3, it also limits the pivot angle of the respective support element 5 about its respective pivot axis 9. However, this does not have to be the case.

The support elements 5 used in the first exemplary embodiment are all formed in an identical manner. In the exemplary embodiment shown, they are bodies which are configured in an integral manner and the parts of which are connected together rigidly. To this extent, the support elements 5 can also be called integral blocking hooks. The support elements 5 are displaceable along the guide element 3 or in the longitudinal direction 4 thereof, although the displaceability is limited by the upper stop 16 and the lower stop 15. It would be conceivable in principle to set the distance between the upper and lower stops 16 and 15 in a permanently fixed manner to a dimension which corresponds to the longitudinal extent 20 of one of the support elements 5 in the blocking position plus the sum of the longitudinal extents 19 of the remaining support elements 5 in the releasing position. This would make it possible for one of the support elements 5 to be moved into the blocking position by pulling out a drawer or a pull-out furniture part, as a result of which, on account of the stops 15 and 16, a further support element 5 is prevented from being able to pivot from the releasing position into the blocking position, as a result of which, as soon as a drawer or a pull-out furniture part has been pulled out, further pull-out furniture parts are prevented from being pulled out.

In the exemplary embodiment shown, it is a somewhat more complicated construction. The lower stop 15 is fastened fixedly to the guide rail 2, while the upper stop 16 itself can be pushed some way upward against a spring (not illustrated here), until it butts against a further stop (not illustrated here) located above and as a result forms a stop, which can be displaced no further in this position, for the topmost support element 5. This somewhat more complicated variant of the design of the upper stop 16 was selected here in order to configure the pull-out blocking device 1 shown in a lockable manner. To this end, the lock 22 is provided with its rotary catch 23. In the blocking position of the lock 22, the rotary catch 23, which is formed as an eccentric, prevents the stop 16 from being able to be moved upward out of the position shown in FIG. 2. As a result, all the support elements 5 are kept in their releasing position, pivoting into the blocking position is not possible in this blocked-off state of the pull-out blocking device 1, as a result of which, in this closed position of the lock, none of the pull-out furniture parts, which are not illustrated here but are intended to be assigned in each case to one of the trigger element carriers 21, can be pulled out of the basic furniture structure.

If, by corresponding actuation of the lock 22, the rotary catch 23 is rotated such that it releases the upper stop 16, the latter can be pushed some way upward when one of the support elements 5 is pivoted from the releasing position into the blocking position. The upper stop 16 then reaches its end or stop position when said support element 5 has been pivoted completely into its blocking position. In the first exemplary embodiment shown, it is then no longer possible to pivot further support elements 5 from their releasing position into their blocking position, as a result of which more than one drawer or more than one pull-out furniture part is prevented from being able to be pulled out of the basic structure. In general terms, the distance between the stops 15 and 16 has to be matched to the size of the support elements 5 such that only the desired maximum number of support elements 5 can be moved into the blocking position before the remaining support elements are blocked in a nonpivotable manner in their releasing position and can no longer be pivoted into the blocking position.

Figure 4:
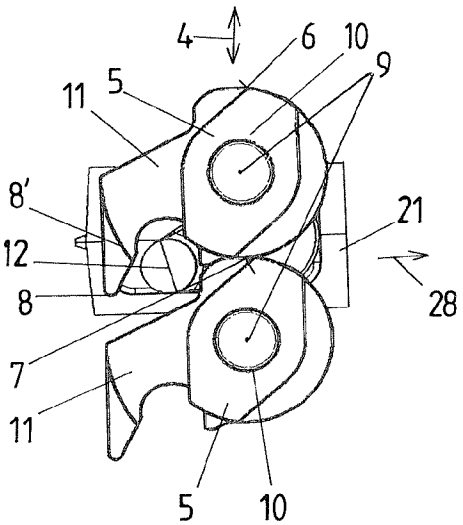
Figure 2:
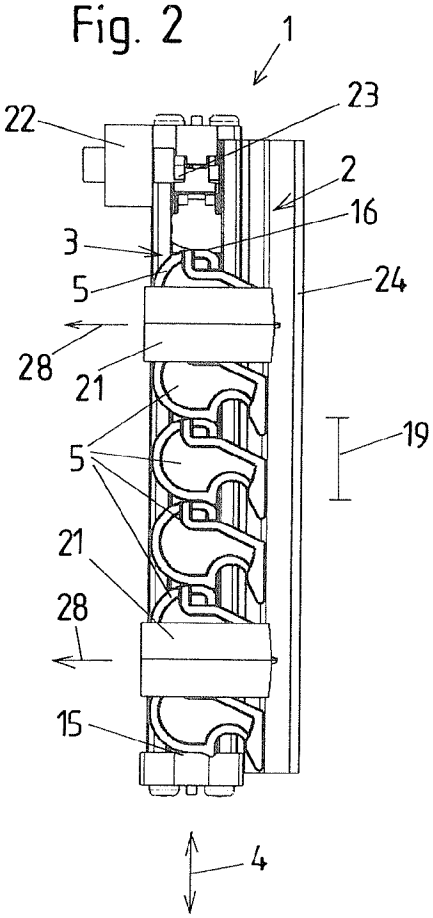
Figure 1:
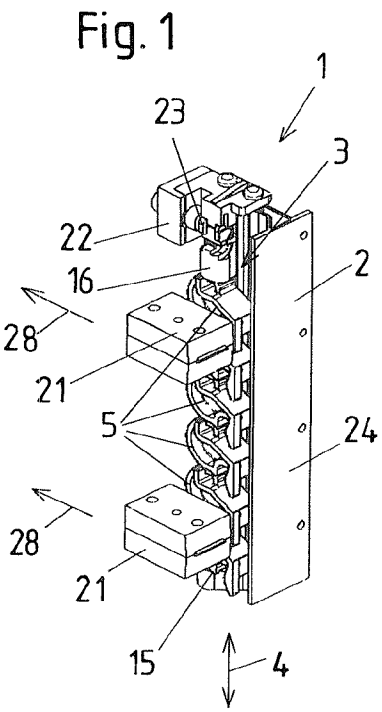
Figure 7:
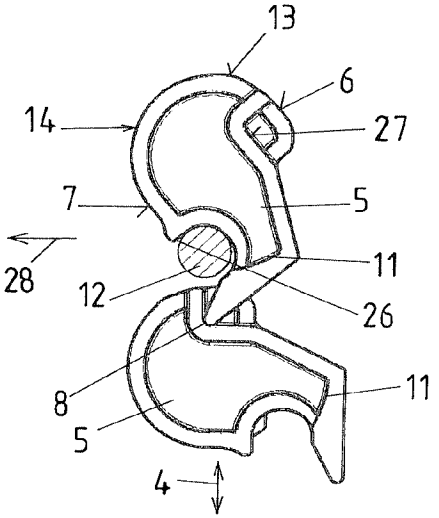
Figure 8:
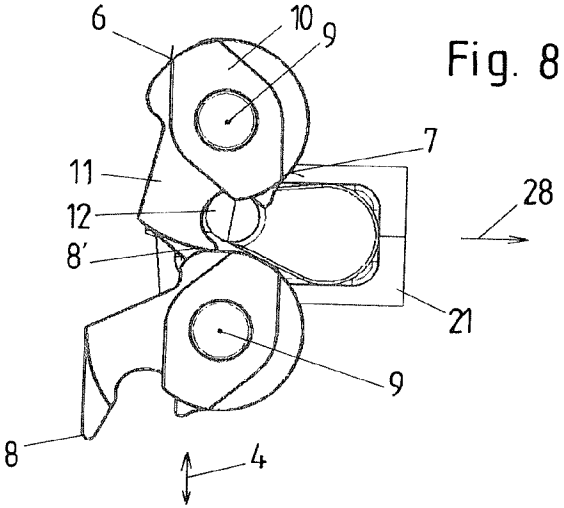
Figure 6:
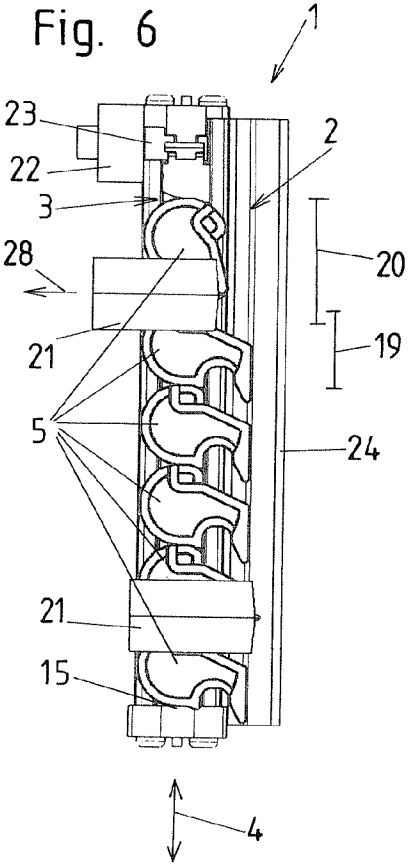
Figure 5:
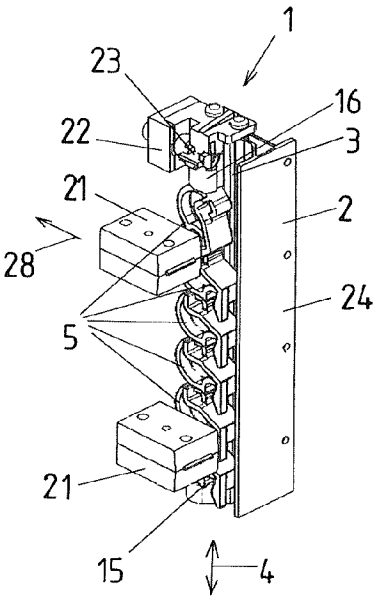
Figure 11:
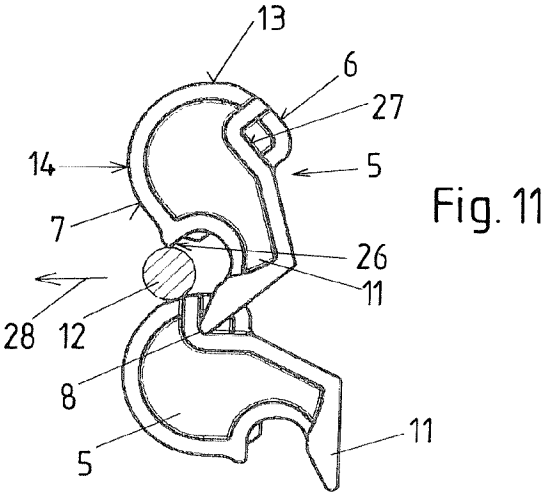
Figure 12:
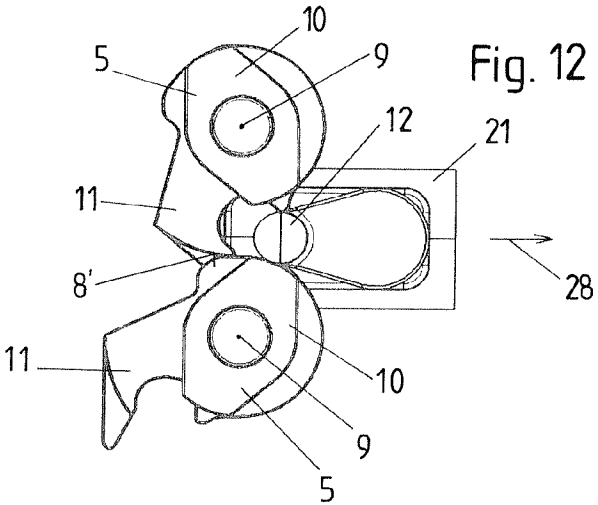
Figure 10:
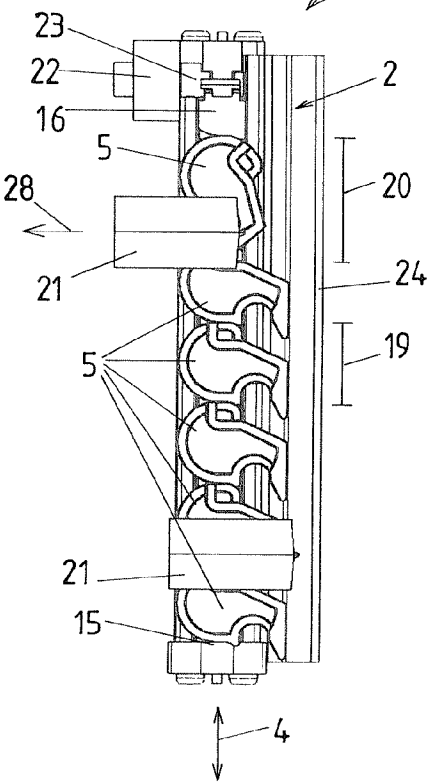
Figure 9:
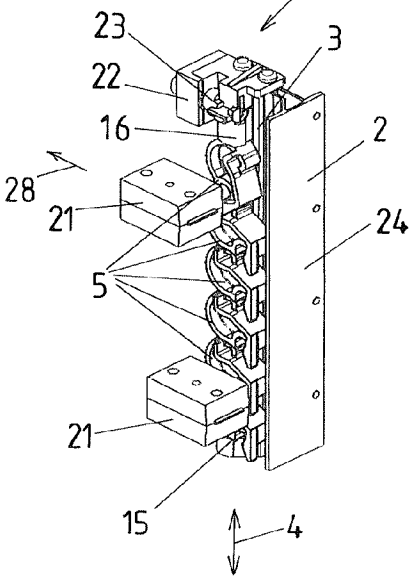
Figure 15:
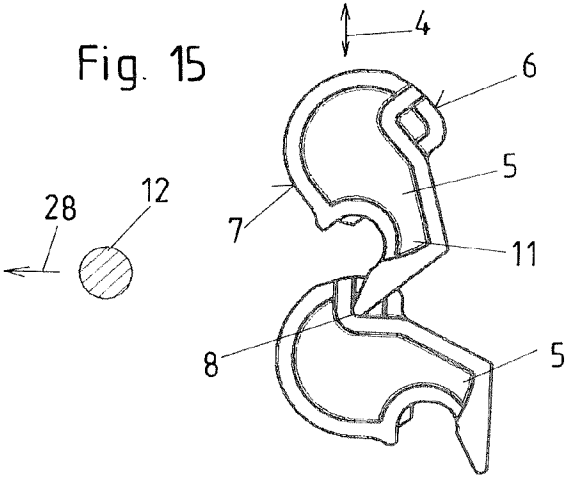
Figure 16:
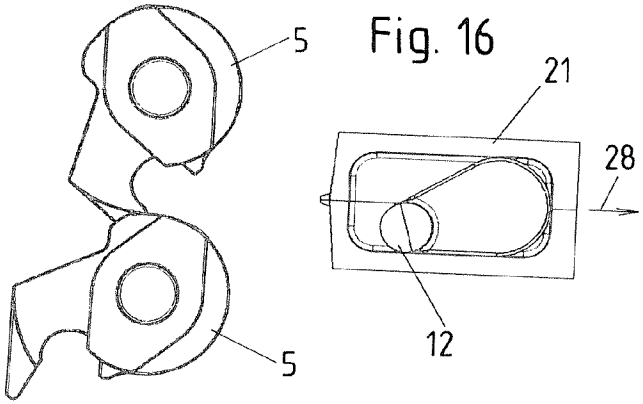
Figure 14:
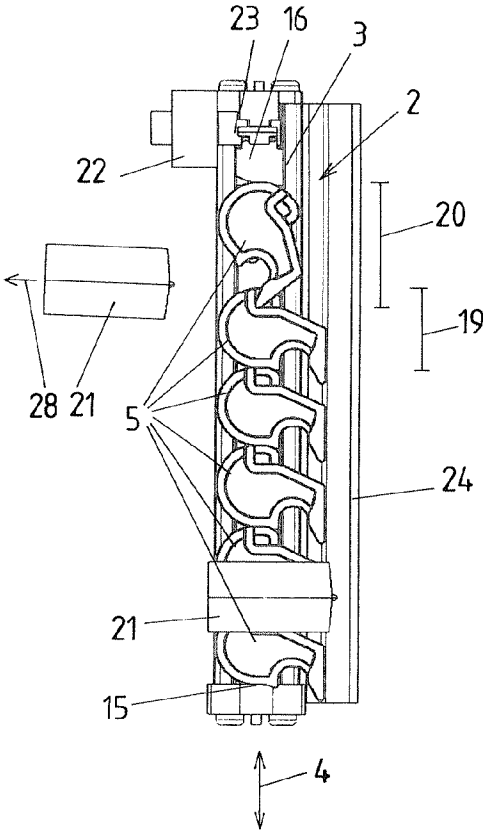
Figure 13:
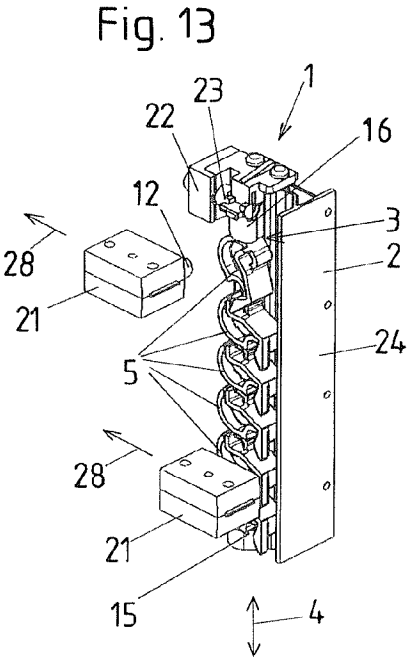
Figure 19:
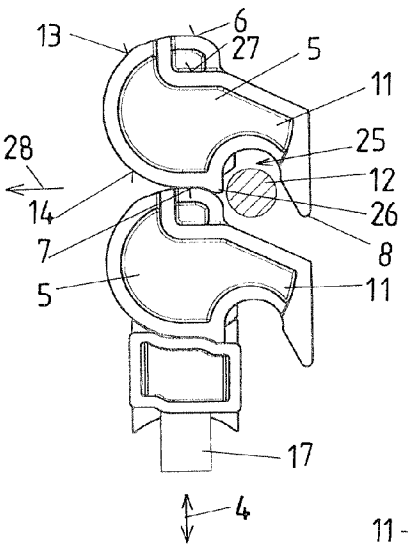
FIGS. 17 to 32 show a second exemplary embodiment according to the invention, in which two of the support elements from the first exemplary embodiment have been replaced by an intermediate element.
Figure 20:
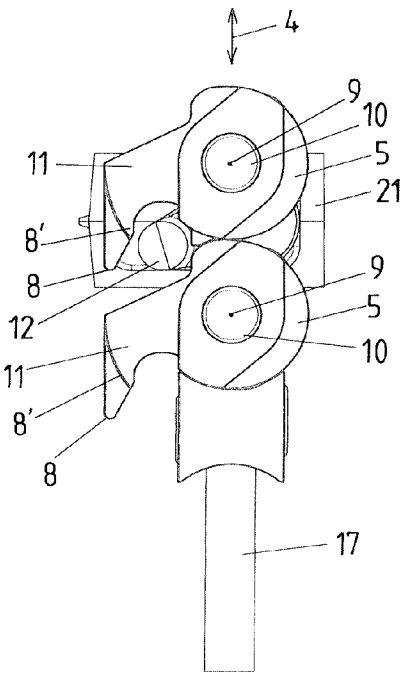
Figure 18:
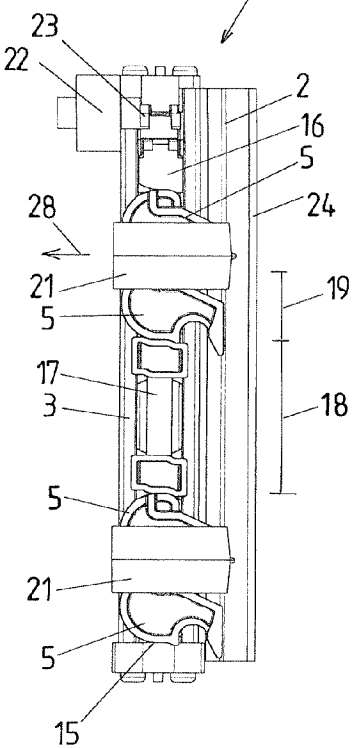
Figure 17:
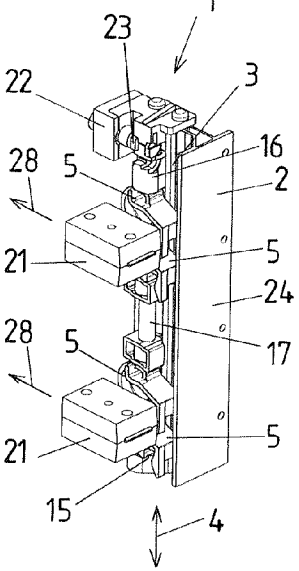
Figure 23:
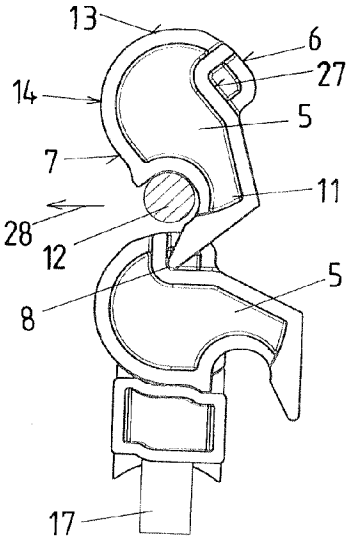
Figure 24:
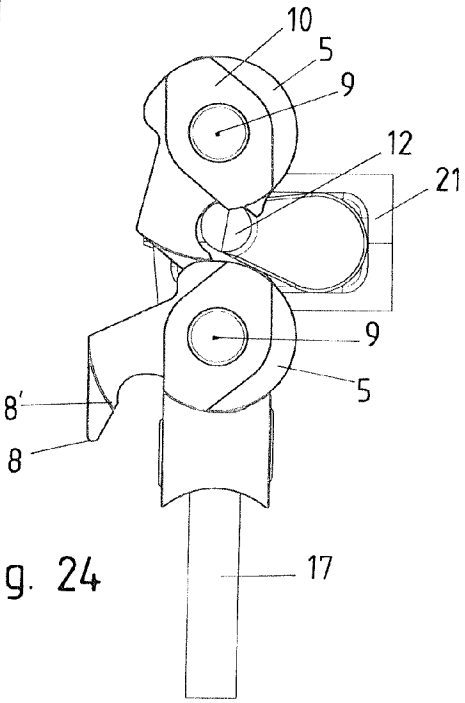
Figure 22:
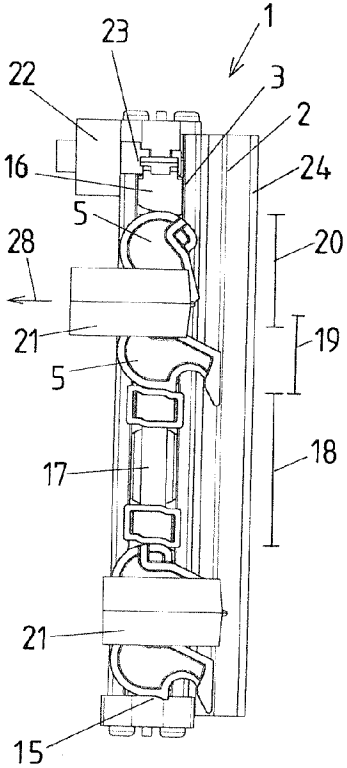
Figure 21:
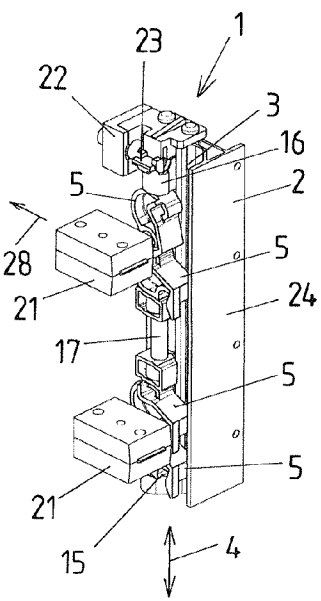
Figure 27:
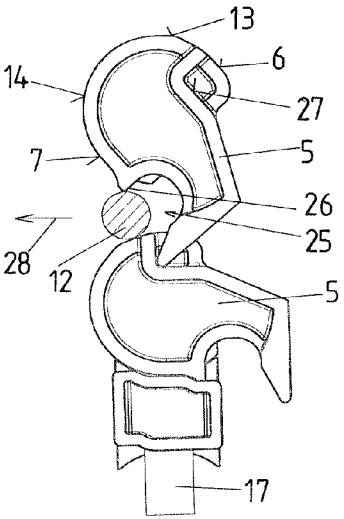
Figure 28:
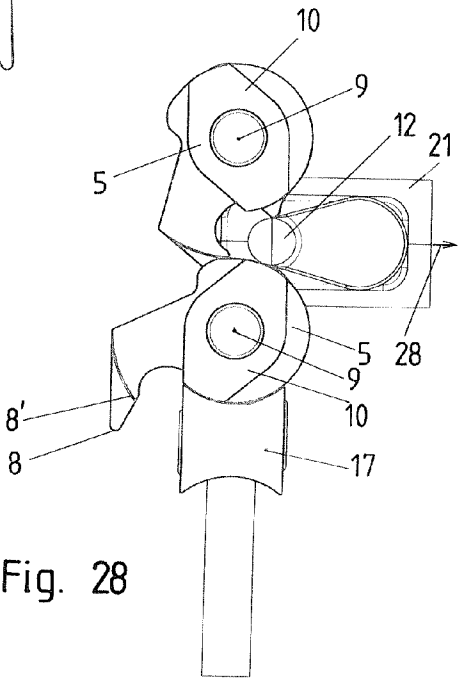
Figure 26:
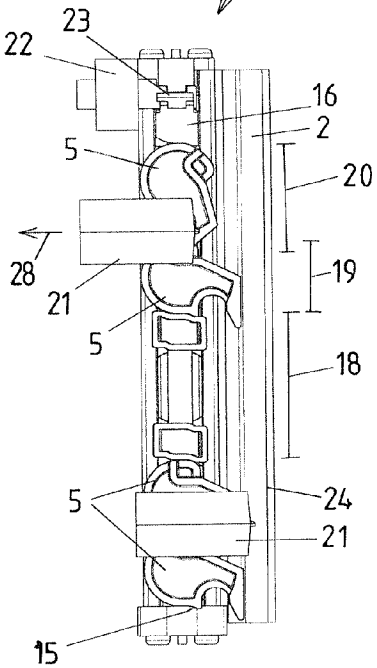
Figure 25:
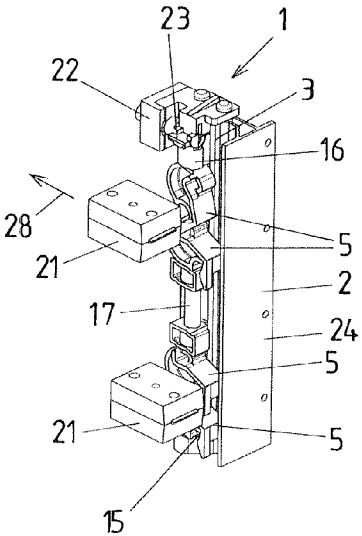
Figure 31:
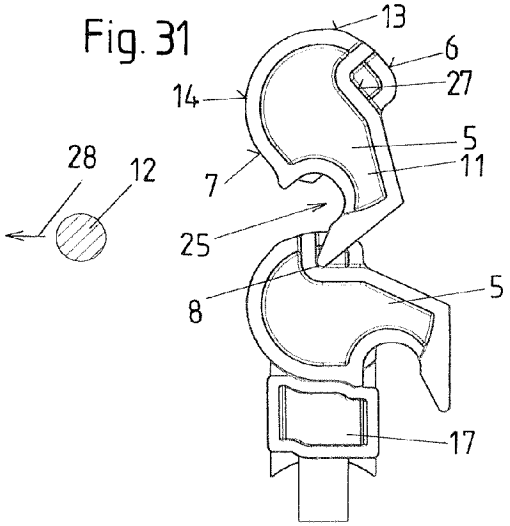
Figure 32:
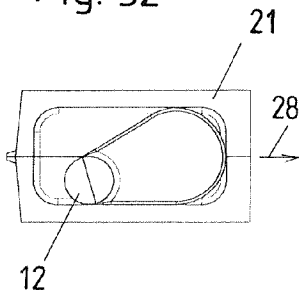
Figure 30:
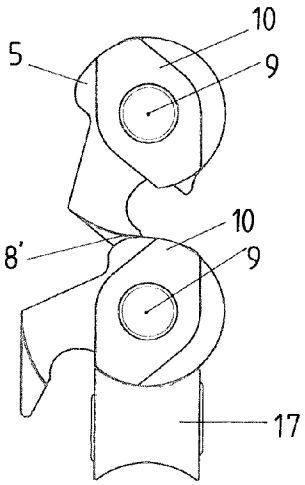
Figure 30:
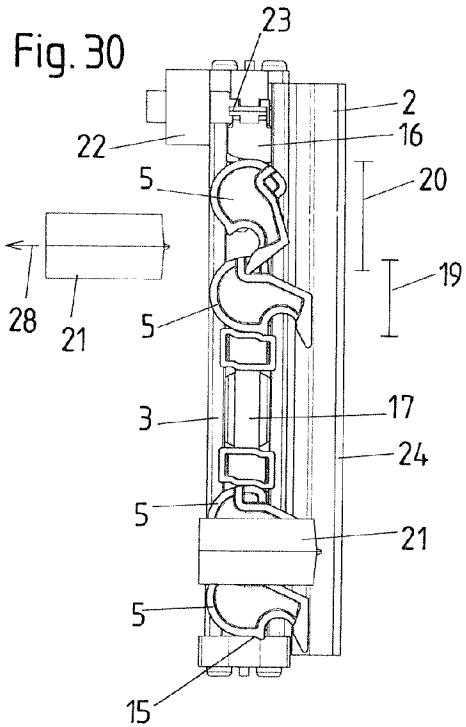
Figure 29:
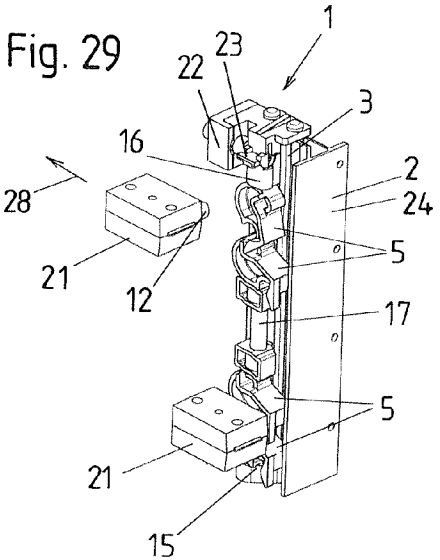

In FIGS. 3 and 4, the two selected support elements 5 are located in their releasing position. In the exemplary embodiment shown, the trigger element 12 connected via the trigger element carrier 21 to the pull-out furniture part (not illustrated here) is formed as a peg and in FIGS. 1 to 4 is still located behind the two support elements 5 illustrated separately in FIGS. 3 and 4 as seen in the pull-out direction 28. More precisely, the trigger element 12 is arranged in this position in a receiving cutout 25 in the pivot arm 11 formed integrally on the support element 5 in an eccentric manner with regard to the pivot axis 9. In this releasing position, the upper support element 5 is supported by way of its lower supporting surface 7 against the upper supporting surface 6 of the support element 5 located beneath. The further supporting surface 8, which is located at that end of the pivot arm 11 that is remote from the respective pivot axis 9 in the exemplary embodiment illustrated, is not active in the releasing position.

A minimal embodiment of support elements 5 according to the invention would provide that each support element has precisely three supporting surfaces, namely an upper supporting surface 6, a lower supporting surface 7 and a further supporting surface 8. In the exemplary embodiment shown, this is realized in a more complicated manner. Thus, in the variant illustrated, two further supporting surfaces 8 and 8' are provided on the pivot arm 11 of the support element 5. In the blocking position shown in the following figures, one of the two further supporting surfaces 8 is supported against an additional supporting surface 27 of the other support element 5, while the second further supporting surface 8' is supported against the upper supporting surface 6 of the support element 5 located beneath. Of course, this is only an example, however, which is intended to show that not just exactly three but also more than three supporting surfaces per support element 5 are possible according to the invention. In this regard, there are numerous different exemplary embodiments. What is important in any case is that the longitudinal extent 20 of the support element 5 in the longitudinal direction 4 is greater in the blocking position than the longitudinal extent 19 of the support element 5 in the longitudinal direction 4 in its releasing position.

A further variant, which is configured in the exemplary embodiment shown but does not absolutely have to be present, is that the trigger element 12 is mounted in a movable manner in relation to the trigger element carrier 21 and thus in relation to the pull-out furniture part (not illustrated here). In the exemplary embodiment shown, this is realized in that the guide peg 12 is arranged in a pivotable manner in the trigger element carrier 21. Other configurations would be displaceable mounting of the trigger element 12 in a corresponding guide groove or the like. The variants with a movable trigger element 12 can be used in order to enable a movement sequence of the overall system of the pull-out blocking device 1 which is as frictionless as possible. In simple variants, the corresponding trigger elements 12 can, however, also be fastened fixedly to the trigger element carrier 21 or to the pull-out furniture part.

As stated, FIGS. 1 to 4 show the position in which the two furniture parts (not illustrated here) have been pushed fully into the basic furniture structure (not illustrated here). In this situation, all the support elements 5 are located in their releasing position. FIGS. 3 and 4 show the position of the trigger element 12 in the pull-out direction 28 behind the upper and lower supporting surfaces 6 and 7, located one above the other, of the support elements 5, located one above the other. If one of the two movable furniture parts, in this case the upper one, is pulled out of the basic furniture structure in the direction 28, then the trigger element 12 strikes the driving nose 26 of the corresponding support element 5 in the exemplary embodiment shown. By pulling the movable furniture part and thus the trigger element 12 further out in the direction 28, one of the support elements 5, in this case the topmost one, is pivoted about the pivot axis 9 from its releasing position into the blocking position illustrated in FIGS. 5 to 8. In the blocking position, in particular according to FIGS. 7 and 8, lower supporting surface 7 of the upper support element 5 no longer rests against the upper supporting surface 6 of the support element 5 which is located beneath and is still in the releasing position. Rather, in the blocking position illustrated in FIG. 7, the further supporting surface 8 of the upper support element 5 is supported on the additional supporting surface 27 and the second further supporting surface 8' of the upper support element 5 is supported on the upper supporting surface 6 of the support element 5 located beneath. As a result, as already mentioned, the longitudinal extent 20 of the topmost support element 5 is achieved. When said support element 5 is pivoted, the upper stop 16 is pushed upward into its end position by the corresponding differential amount between the longitudinal extents 20 and 19. Thus, it is now no longer possible for a further support element 5 to be pivoted from its releasing position into the blocking position. As a result, in the exemplary embodiment shown, the lower drawer (not shown here), together with the lower trigger element carrier 21, is prevented from being able to be moved out of the fully pushed-in position. In order to be able to pull the trigger element 12 out of the receiving cutout 25 in the support element 5 from the position according to FIGS. 5 to 8, if the movable furniture part is pulled further in the pull-out direction 28, the trigger element 12 is pivoted in the trigger element carrier 21, as a result of which it becomes possible to move the trigger element 12 further in the pull-out direction 28 past the driving nose 26. This situation is illustrated in FIGS. 9 to 12. Subsequently, the trigger element 12 leaves the receiving cutout 25 completely. The pull-out furniture part is then pulled out as far as desired, that is to say at most as far as its opened end position. In the meantime, the support element 5 moved into the blocking position blocks the displaceability of the remaining support elements 5 in the longitudinal direction 4 of the guide element 3 between the stops 15 and 16, and so no further drawer can be pulled out of the pull-out blocking device 1 in the pull-out direction 28. This only possible again when the previously pulled-out displaceable furniture part has been pushed in again to such an extent in the push-in direction, that is to say counter to the direction 28, that the trigger element 12 has pivoted the support element 5 back into its releasing position according to FIGS. 1 to 4 by corresponding abutment against the pivot arm 11.

FIGS. 17 to 32 now show a second exemplary embodiment according to the invention, in which not exclusively only support elements 5 are arranged on the guide element 3. In this exemplary embodiment, a part of the support elements 5 has been replaced by an intermediate element 17. Although the intermediate element 17 is displaceable in the longitudinal direction 4 on the guide element 3, in contrast to the support elements 5, it is not pivotable. Corresponding intermediate elements 17 can be used as replacements for support elements 5 wherever no trigger elements 12 are moved in and out. It is thus possible to bridge corresponding gaps between pull-out furniture parts or drawers by way of the intermediate elements 17. At the upper end, the intermediate element 17 has a supporting surface which interacts with the lower supporting surface 7 of the support element 5 located above and the shape of which corresponds thereto. At its lower end, the intermediate element 17 has a corresponding lower supporting surface which interacts with the upper supporting surface 6 of the support element 5 located beneath and is formed in a manner corresponding thereto. The longitudinal extent 18 of the intermediate element 17 should fit into the unit spacing defined by the support elements 5. It is preferably provided that the longitudinal extent 18 of the intermediate element 17 in the longitudinal direction 4 corresponds to the longitudinal extent 19 of a support element 5 in the same direction, or is a real integer multiple, that is to say an integer multiple greater than or equal to 2.

The replacement of support elements 5, the functionality of which is not required at this point, with corresponding intermediate elements 17, changes nothing with regard to the functioning of the pull-out blocking device 1. Technically, the second exemplary embodiment functions in exactly the same way as has already been described for the first exemplary embodiment. In FIGS. 17 to 32, illustrations corresponding to FIGS. 1 to 16 were used, the situation according to FIG. 17 corresponding to the situation according to FIG. 1, the situation according to FIG. 18 corresponding to the situation according to FIG. 2, etc. Generally, it thus suffices, apart from the outlined differences between the exemplary embodiments, to refer to the technical description of the first exemplary embodiment with regard to the technical description of the second exemplary embodiment.

KEY TO THE REFERENCE SIGNS

1 Pull-out blocking device
2 Guide rail
3 Guide element
4 Longitudinal direction
5 Support element
6 Upper supporting surface
7 Lower supporting surface
8, 8' Further supporting surface
9 Pivot axis
10 Guide peg
11 Pivot arm
12 Trigger element
13 Run-on slope
14 Run-on slope
15 Stop
16 Stop
17 Intermediate element
18 Longitudinal extent
19 Longitudinal extent
20 Longitudinal extent
21 Trigger element carrier
22 Lock
23 Rotary catch
24 Mounting plate
25 Receiving cutout
26 Driving nose
27 Additional supporting surface
28 Pull-out direction
29 Head plate

The invention claimed is:

1. A pull-out blocking device (1) for at least two furniture parts that can be pushed into a basic furniture structure and can be pulled out of the basic furniture structure, the pull-out blocking device (1) comprising at least one guide rail (2) and a sequence of support elements (5) mounted on an elongate guide element (3) of the guide rail (2) such as to be displaceable in a longitudinal direction (4) thereof, each of the support elements (5) having, as seen in an operating position of the pull-out blocking device (1), an upper supporting surface (6) for abutment against one of the support elements (5) arranged adjacently above and a lower supporting surface (7) for abutment against one of the support elements (5) arranged adjacently below and at least one further supporting surface (8) for abutment against the support element (5) arranged adjacently above or below, each of the support elements (5) having a releasing position for abutment by way of the upper supporting surface (6) thereof against the support element (5) arranged adjacently above and for abutment by way of the lower supporting surface (7) thereof against the support element (5) arranged adjacently below, and each of the support elements (5) having a blocking position for abutment by way of the further supporting surface (8) thereof against the support element (5) arranged adjacently above or below, wherein each of the support elements (5) is formed as a body that connects the upper supporting surface (6) and the lower supporting surface (7) and the further supporting surface (8) together in an inherently rigid manner, and wherein each of the support elements (5) is arranged on the guide element (3) to be pivotable about a pivot axis (9) between the blocking position and the releasing position, and wherein all the supporting surfaces (6, 7, 8) are arranged outside the guide element (3).

2. The pull-out blocking device (1) as claimed in claim 1, wherein each of the support elements (5) has a guide peg (10) for displaceable mounting on the guide element (3).

3. The pull-out blocking device as claimed in claim 2, wherein the guide peg is T-shaped.

4. The pull-out blocking device (1) as claimed in claim 1, wherein each of the support elements (5) is formed as a body in an inherently integral manner, which connects the lower supporting surface (7) and the upper supporting surface (6) and the further supporting surface (8).

5. The pull-out blocking device as claimed in claim 4, wherein the body is also connected to the guide peg (10) in an inherently integral manner.

6. The pull-out blocking device (1) as claimed in claim 1, wherein each of the support elements (5) is formed as an integral, plastic body or as an integral metal or ceramic body.

7. The pull-out blocking device (1) as claimed in claim 1, wherein each of the support elements (5) has a pivot arm (11), which is arranged eccentrically with regard to the pivot axis (9) thereof, adapted to pivot the support element (5) about the pivot axis (9) by a trigger element (12) arranged on the pull-out furniture part.

8. The pull-out blocking device (1) as claimed in claim 1, wherein the upper supporting surface (6) and the lower supporting surface (7) each have a run-on slope (13, 14) for a trigger element (12) arranged on the pull-out furniture part.

9. The pull-out blocking device (1) as claimed in claim 8, wherein one of the trigger elements (12), which is arranged on the pull-out furniture part, is able to pass through between two support elements (5) arranged adjacent to one another, the trigger element (12) forcibly pivoting one of the support elements (5) from the releasing position into the blocking position or vice versa as said trigger element (12) passes through.

10. The pull-out blocking device as claimed in claim 9, wherein there is precisely one of the trigger elements (12).

11. The pull-out blocking device as claimed in claim 8, wherein the trigger element (12) is peg-shaped.

12. The pull-out blocking device (1) as claimed in claim 1, wherein a displaceability of the support elements (5) along the guide element (3) is confined between two stops (15, 16), all the remaining support elements (5) being fixed in position in relation to the stops (15, 16) when at least one of the support elements (5) has been arranged in the blocking position.

13. The pull-out blocking device (1) as claimed in claim 1, wherein all of the support elements (5) of the pull-out blocking device (1) have an identical shape to one another.

14. The pull-out blocking device as claimed in claim 1, wherein the at least two furniture parts comprise drawers.

15. The pull-out blocking device as claimed in claim 1, wherein the upper supporting surface (6) directly abuts against the one of the support elements (5) arranged adjacently above and the lower supporting surface (7) directly abuts against the one of the support elements (5) arranged adjacently below and the at least one further supporting surface (8) directly abuts against the support element (5) arranged adjacently above or below.

* * * * *